United States Patent [19]

Polaschegg

[11] 4,067,697

[45] Jan. 10, 1978

[54] TEST BAR FOR A VACUUM CHAMBER

[75] Inventor: Hans-Dietrich Polaschegg, Bornheim-Walberberg, Germany

[73] Assignee: Leybold-Heraeus GmbH & Co. KG, Cologne, Germany

[21] Appl. No.: 666,498

[22] Filed: Mar. 12, 1976

[30] Foreign Application Priority Data

Mar. 12, 1975 Germany ..... 2510683

[51] Int. Cl.[2] ..... B01L 1/02

[52] U.S. Cl. ..... 23/259; 118/49; 214/17 B; 214/26; 250/289

[58] Field of Search ..... 23/259, 253 R, 253 PC; 118/48, 49, 49.1, 49.5; 250/288, 289; 214/17 B, 26; 73/422 GC, 421.5 R

[56] References Cited

U.S. PATENT DOCUMENTS

| | | | |
|---|---|---|---|
| 3,394,679 | 7/1968 | Bentley, Jr. | 118/49 |
| 3,578,969 | 5/1971 | Proskauer | 250/288 |
| 3,633,770 | 1/1972 | Howard | 214/17 B |

FOREIGN PATENT DOCUMENTS

| | | | |
|---|---|---|---|
| 1,184,356 | 3/1970 | United Kingdom | 118/48 |

*Primary Examiner*—Morris O. Wolk
*Assistant Examiner*—Arnold Turk
*Attorney, Agent, or Firm*—Spencer & Kaye

[57] ABSTRACT

Device for introducing a specimen into and withdrawing the same from the interior of a chamber sealed from the surrounding environment. The device includes a test bar slidably and sealingly projecting through an opening in the chamber. The test bar has a first length portion which includes a specimen-supporting arrangement and which has a part that is in a sealing relationship with the opening in a first end position of the test bar in which the specimen-supporting arrangement is situated inside the chamber. The test bar further has a second length portion which has a part that is in a sealing relationship with the opening in a second end position of the test bar in which the specimen-supporting arrangement is situated externally of the chamber. A releasable coupling device detachably connects the two length portions of the test bar to one another.

7 Claims, 4 Drawing Figures

TEST BAR FOR A VACUUM CHAMBER

BACKGROUND OF THE INVENTION

This invention relates to a device for introducing an article into and withdrawing the same from the interior of a chamber sealed from the surrounding environment. More particularly, the invention relates to a test bar movably supported in a gastight manner in a housing coupled with a vacuum chamber. The test bar is adapted to support a sample, for example, in a recess, and has a length so dimensioned that the bar, whether the recess is internally or externally of the chamber, performs its function regarding the sealing of the chamber with respect to its environment.

It is a common characteristic of a great number of manufacturing or testing methods involving vacuumized environment that the articles, substances, substrates or specimens (hereinafter simply referred to as "specimen") have to be brought into a closed vacuum vessel from the ambient, atmospheric environment. In the simplest case, the vacuum device is de-vacuumized, opened and the specimens are introduced. Thereafter the device is again closed and evacuated. Particularly when the specimen is to be exposed to high vacuum or ultra high vacuum, the above-outlined mode of introducing the specimen inherently involves significant loss of time. For this purpose, various types of vacuum locks have been designed.

The locks in general comprise a vacuumizable pre-chamber which is closed by two sealing systems or valves. This pre-chamber is coupled through one sealing system or valve with the principal vacuum chamber and through a further sealing system or valve with the atmospheric air. The specimen is first brought from the atmosphere into the pre-chamber. Thereafter the pre-chamber is vacuumized, whereupon the specimen is moved into the principal vacuum chamber. According to a particularly advantageous known solution of a vacuum lock, the specimen is positioned in a recess of an otherwise linear, smooth and polished cylindrical bar. The bar which serves for transporting the specimen from the atmospheric outer environment into the principal vacuum chamber is guided in a housing coupled to the vacuum chamber. In the housing, there are provided O-rings or O-ring systems surrounding the rod for providing a packing system for sealing the chamber from the surrounding environment. Since the bar should perform its sealing function in any geometric position of the specimen, the bar has to extend on either side of the specimen to such a distance that the bar, in any position, fully cooperates with the O-ring system. Instead of O-rings, other sealing arrangements may be used, such as magneto-fluid or labyrinth seal. It is a disadvantage of this arrangement that in case the test bar is to be replaced, the entire vacuum system has to be de-vacuumized if no additional valve is provided. Such a replacement is necessary, for example, if a specimen or several specimens are to be handled under different conditions. Thus, different test bars are used for different temperature ranges (for example, for ranges of −180° to +350° C, 20° to 600° C and 20° to 1500° C) and for different specimen configurations.

SUMMARY OF THE INVENTION

It is an object of the invention to provide an improved test bar of the above-outlined type which renders unnecessary a de-vacuumization of the vacuum system for replacing the test bar and which also renders unnecessary the provision of an additional valve.

This object and others to become apparent as the specification progresses, are accomplished by the invention, according to which, briefly stated, the test bar has a first length portion which includes a specimen-supporting arrangement and which has a part that is in a sealing relationship with the chamber in a first end position of the test bar in which the specimen-supporting arrangement is situated inside the chamber. The test bar further has a second length portion which has a part that is in a sealing relationship with the chamber in a second end position of the test bar in which the specimen-supporting arrangement is situated externally of the chamber. A releasable coupling device detachably connects the two length portions of the test bar to one another.

For replacing that test bar portion which contains the specimen-receiving recess, the test bar is pulled out of the vacuum chamber up to and including the parting zone defined with the other test bar portion so that the two test bar portions can be separated from one another externally of the vacuum chamber. The remaining test bar portion, which for all types of test bars may be of identical configuration without limiting its function, stays in the assembly as a sealing member. The insertion of the new test bar portion (having properties regarding the specimen-receiving recess or temperature different from those of the test bar portion previously disconnected) is effected in a reverse order.

DESCRIPTION OF THE PREFERRED EMBODIMENTS

Figure 1:
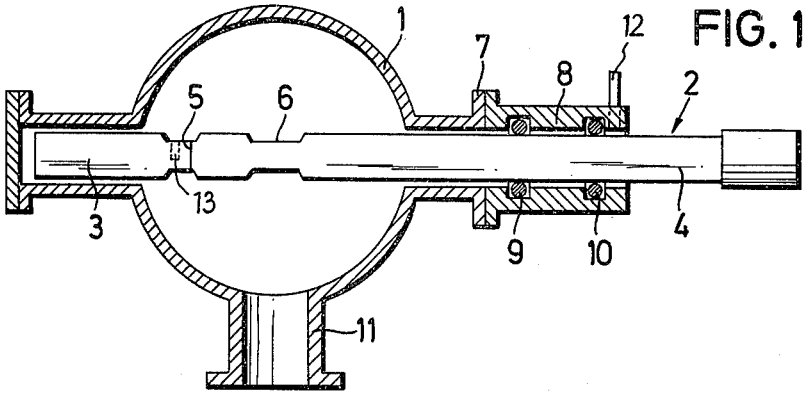
FIG. 1 is a sectional side elevational view of a vacuum chamber incorporating the invention, wherein the test bar is shown in a fully advanced position.

Turning now to FIG. 1, there is shown a vacuum chamber 1 which slidably receives a test bar generally indicated at 2. The test bar 2 is formed of length portions 3 and 4 which, according to the invention, are detachably secured to one another by a releasable coupling device (not illustrated in FIG. 1) and have a parting zone 5. The test bar portion 4 is provided with a specimen-receiving recess or depression 6 which, in FIG. 1, is shown in its operational position, since the test bar 2 is illustrated in its fully advanced (pushed-in) state. The vacuum chamber 1 has a flange 7 by means of which the vacuum chamber 1 is coupled with a housing 8 having an opening through which the test bar 2 passes in a vacuumtight manner. For this purpose, in the housing 8 there are provided, in circumferential grooves of the housing wall, O-rings 9 and 10 which surround and sealingly engage the test bar 2 about its circumference. The vacuum chamber 1 further has a coupling nipple 11 which is connected with a vacuum pump, not shown.

Figure 2:
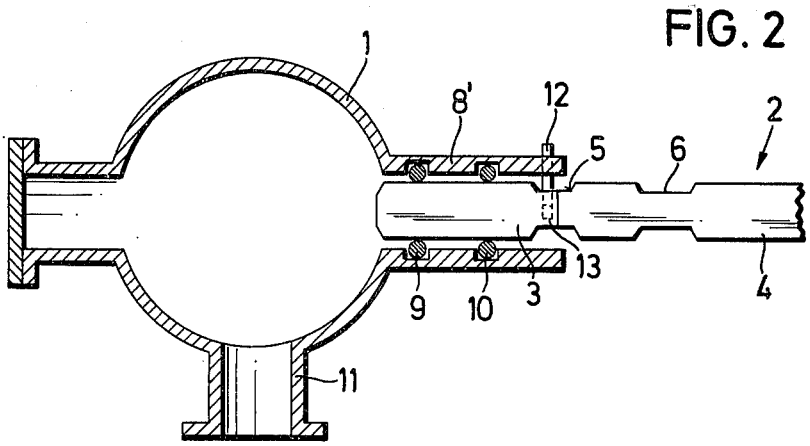
FIG. 2 is a sectional side elevational view of a slightly modified vacuum chamber, wherein the test bar is shown in a withdrawn position.

Turning now to FIG. 2, it is seen that the test bar 2 is withdrawn to such an extent that the specimen-receiving recess 6 and the parting zone 5 are situated externally of the vacuum chamber 1 and more particularly, externally of the sealing assembly 9, 10. In this position, the test bar portion 3 of the test bar 2 is immobilized by means of a locking pin 12 supported at the outer rim of the housing 8' and movable normal to the path of motion of the test bar 2. In the immobilizing position, the locking pin 12 projects into an aperture 13 in the test bar portion 3. In this position of the test bar 2, the test bar portion 4 can be detached from the test bar portion 3 and thus another test bar portion which, for example, has a differently shaped specimen-receiving recess can be inserted. It is noted that in FIG. 2 the housing 8' is formed as a one-piece, integral member with the vacuum chamber 1.

Figure 3:
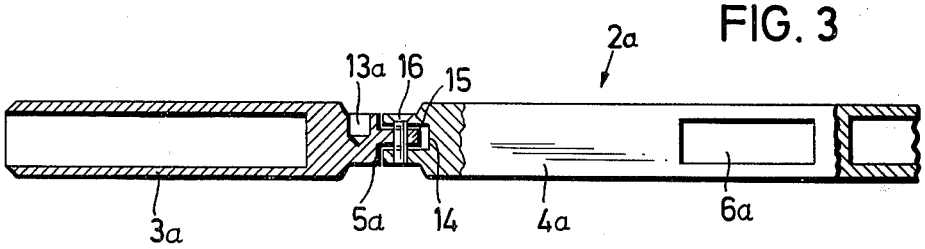
FIG. 3 is a longitudinal sectional view of a preferred embodiment of the invention.

Turning now to FIG. 3, the test bar 2*a* is shown in section to illustrate a preferred embodiment of a releasable coupling device connecting the test bar portions to one another. The test bar 2*a* is formed of separable test bar portions 3*a* and 4*a* being in engagement along the parting zone 5*a*. The test bar portion 4*a* has a central opening 6*a* adapted to receive a specimen. For purposes of a light-weight construction, both test bar portions 3*a* and 4*a* are, at least partially, of hollow, tubular shape. The test bar portion 4*a* has, in the parting zone 5*a*, an axial bore 14 into which fits a stub portion 15 which is integral with the test bar portion 3*a* which is oriented in the length dimension of the test bar. The test bar portions 3*a* and 4*a* are secured to one another by means of a pin or screw member 16 which passes transversely through the bore 14 and the stub portion 15 positioned therein. The test bar portion 3*a* is further provided, adjacent the stub portion 15, with a blind bore 13*a* which, similarly to the aperture 13 of FIGS. 1 and 2, serves for receiving an immobilizing pin for temporarily fixedly holding the test bar portion 3*a* while the test bar portion 4*a* is removed or attached. The required venting of the bore 14 is effected by longitudinal grooves (not shown) provided on the stub portion 15 and the pin 16.

Figure 4:
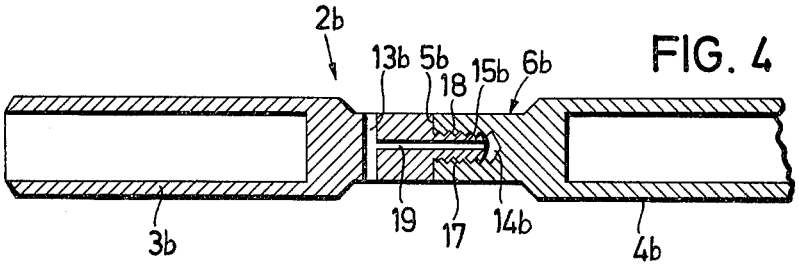
FIG. 4 is a longitudinal sectional view of another preferred embodiment of the invention.

Turning now to the embodiment of FIG. 4, the test bar generally indicated at 2*b* is formed of test bar portions 3*b* and 4*b*. The latter carries the specimen-receiving depression 6*b*. The parting zone 5*b* is located within the zone of the depression 6*b*. At the end of the test bar portion 4*b* there is provided an axial bore 14*b* having an internal thread 17. The test bar portion 3*b* has an axial stub 15*b* provided with an external thread 18 and oriented in the length dimension of the test bar. It will thus be apparent that an engagement or disengagement of the test bar portions 3*b* and 4*b* is effected by relative rotation of the two test bar portions with respect to one another. The axial stub 15*b* has an axial channel 19 which communicates with a transverse bore 13*b* provided in the test bar portion 3*b*. The bore 13*b*, as the components 13 and 13*a* of the precedingly-described structures, serves for receiving an immobilizing pin held in the wall of the vacuum chamber externally of the sealing assembly. The bore 14*b* is vented through the channel 19 and the bore 13*b*.

It is seen that the releasable coupling arrangement for interconnecting the first test bar portion (4 or 4*a* or 4*b*) with the second test bar portion (3 or 3*a* or 3*b*) is so structured that in the coupled state a pulling or pushing force exerted on the first test bar portion is transmitted to the second test bar portion. Consequently, in response to such forces, the two test bar portions slide as a one-piece unit.

The invention may find application not only in vacuum systems, it may serve as well for conveying a specimen between the atmosphere and a chamber containing a liquid such as water. Further, it is to be understood that the invention is not limited to the two specific coupling mechanisms illustrated in FIGS. 3 and 4, respectively; such coupling means may be constituted by a wide variety of conventional connecting arrangements, including, for example, bayonet couplings and releasable snap-in couplings.

It is to be understood that the above description of the present invention is susceptible to various modifications, changes and adaptations, and the same are intended to be comprehended within the meaning and range of equivalents of the appended claims.

What is claimed is:

1. A device for introducing a specimen into and withdrawing the same from the interior of a chamber sealed from the environment external to the chamber; the device having means defining an opening in the chamber; a test bar projecting through the opening and being slidable with respect thereto; and specimen-receiving means provided on the test bar; the test bar having a first end position in which the specimen-receiving means is situated inside the chamber and a second end position in which the specimen-receiving means is situated externally of the chamber; the test bar being in sealing relationship with the opening in any position of the test bar between and including the two end positions for sealing the inside of the chamber from the environment external to the chamber; the improvement wherein said test bar has a. a first length portion including said specimen-receiving means and including a part being in sealing relationship with said opening in said first end position of said test bar;

b. a second length portion including a part being in sealing relationship with said opening in said second end position of said test bar; said first and second length portions being constituted as separate members engaging one another in a parting zone; and c. releasable coupling means for detachably attaching said second length portion to said first length portion and for transmitting to said second test bar portion any external displacement force exerted on said first test bar portion, whereby said first and second test bar portions are displaced as a unit by such forces.

2. A device as defined in claim 1, wherein said specimen-receiving means includes a recess provided in said first length portion of said test bar; said parting zone and said recess being situated in an immediately adjoining relationship along the length dimension of said test bar.

3. A device as defined in claim 1, wherein said releasable coupling means includes a. means defining a bore in one of said length portions, said bore having an axis extending parallel to the length dimension of said test bar;

b. a stub portion projecting from the other of said length portions in a direction parallel to the length dimension of said test bar for being received in said bore; and c. removable securing means for retaining said stub portion in said bore.

4. A device as defined in claim 3, wherein said removable securing means is a pin passing through aligned openings provided in said one length portion in the zone of said bore and in said other length portion in said stub portion.

5. A device as defined in claim 1, wherein said releasable coupling means includes a. means defining an internally threaded bore in one of said length portions, said bore having an axis extending parallel to the length dimension of said test bar; and b. an externally threaded stub portion projecting from the other of said length portions in a direction parallel to the length dimension of said test bar for being threadedly received in said bore.

6. A device as defined in claim 1, further comprising a locking pin slidably supported in and by a wall of said chamber in the zone of said opening; and means defining an aperture in said second length portion of said test bar; said aperture being aligned with said locking pin and receiving the same in said second end position of said test bar.

7. A device as defined in claim 1, wherein at least one of said length portions is at least partially hollow.

* * * * *